United States Patent [19]

Kawamura

[11] Patent Number: 4,511,792

[45] Date of Patent: Apr. 16, 1985

[54] VOLTAGE CONTROL CIRCUIT FOR PROTECTING GLOW PLUG FROM OVERHEATING

[75] Inventor: Hideo Kawamura, Kanagawa, Japan

[73] Assignee: Isuzu Motors Limited, Tokyo, Japan

[21] Appl. No.: 392,519

[22] Filed: Jun. 28, 1982

[30] Foreign Application Priority Data

Jun. 30, 1981 [JP] Japan ..... 56-102071
Jun. 30, 1981 [JP] Japan ..... 56-102072

[51] Int. Cl.[3] ..... H05B 1/02

[52] U.S. Cl. ..... 219/499; 219/492; 219/202; 219/508; 219/497; 123/179 H; 361/91

[58] Field of Search ..... 219/514, 492, 493, 505, 219/501, 202, 203, 499, 507–510; 361/91; 123/179 H, 179 B, 179 BG

[56] References Cited

U.S. PATENT DOCUMENTS

| | | | |
|---|---|---|---|
| 4,002,882 | 1/1977 | McCutchen | 219/497 |
| 4,036,199 | 7/1977 | Chateau | 361/91 |
| 4,114,582 | 9/1978 | Rabus et al. | 361/91 |
| 4,280,452 | 7/1981 | Kawamura et al. | 219/499 |
| 4,285,307 | 8/1981 | Steinke | 123/179 H |
| 4,331,109 | 5/1982 | Arnault | 123/179 H |

FOREIGN PATENT DOCUMENTS

| | | | |
|---|---|---|---|
| 2306372 | 8/1974 | Fed. Rep. of Germany | 219/514 |
| 0018257 | 10/1980 | France . | |
| 18068 | 2/1981 | Japan | 123/179 H |
| 2024951 | 1/1980 | United Kingdom . | |
| 2031516 | 4/1980 | United Kingdom . | |
| 2058217 | 4/1981 | United Kingdom . | |

OTHER PUBLICATIONS

Patents Abstracts of Japan, vol. 4, No. 29, Mar. 1980, pp. (M–2) [511]; vol. 3, No. 101, Aug. 1979, pp. (M–70).

*Primary Examiner*—M. H. Paschall
*Attorney, Agent, or Firm*—Staas & Halsey

[57] ABSTRACT

A circuit for controlling the voltage applied to a glow plug used to assist the starting of a diesel engine, the circuit including a circuit network including a normally-closed relay contact connected in parallel with a serially connected voltage-dropping resistor and a normally-open relay contact, the circuit being serially connected with the heating element of the glow plug and with a power supply for producing the voltage, and a timer connected to the power supply. The normally-closed relay contact is opened when the temperature of the heating element exceeds a preset value which is below a steady-state heating temperature, and the normally-open relay contact is closed by the timer a predetermined time after voltage is applied to the glow plug, whereby the glow plug is heated rapidly. In the event of an abnormal rise in power supply voltage during the rapid heating of the glow plug, the supply of current to the glow plug is interrupted temporarily to prevent glow plug burn-out.

8 Claims, 4 Drawing Figures

VOLTAGE CONTROL CIRCUIT FOR PROTECTING GLOW PLUG FROM OVERHEATING

BACKGROUND OF THE INVENTION

This invention relates to voltage control circuit for protecting glow plugs which assist in starting a diesel engine, from overheating.

It is well known in the art to use glow plugs in order to improve diesel engine starting characteristic.

Heretofore, it takes about five to seven seconds to preheat a combustion chamber to a preset preheating temperature (about 900° C.). In the case of a preheating speed of this order, even if the supply voltage is somewhat increased, no seriously bad influence is caused although the preheating speed may be slightly increased. However, it is rather difficult for an operator who has been familiar with gasoline engines to have a wait for a preheating time, five to seven seconds in starting the diesel engine. Accordingly, it is desirable to reduce the preheating time. In order to meet this requirement, an ultra-high-speed heating operation has this requirement, a method has been employed in which the resistance of the heat generating coil in a glow plug is greatly reduced to increase the heating current, thereby to quickly preheat the combustion chamber; i.e., a so-called "ultra-high-speed heating operation" is carried out. However, the method is disadvantageous in the following point: In the ultra-high-speed heating operation, as the resistance of the heat generating coil is extremely small, heating the glow plug response sharply and quickly to the variation of the supply voltage. Therefore, the heating speed is increased as the voltage increases. That is, overheating occurs, so that the heat generating coil is broken off or molten off.

SUMMARY OF THE INVENTION

Accordingly, an object of the present invention is to provide a voltage control circuit for a glow plug used to assist the starting operation of a diesel engine, wherein overheating is prevented even if the glow plug is rapidly elevated in temperature.

Another object of the present invention is to provide a voltage control circuit for a glow plug used to assist the starting operation of a diesel engine, wherein the glow plug will not burn out even in the event of an abnormal increase in power supply voltage during rapid heating of the glow plug.

DESCRIPTION OF THE PREFERRED EMBODIMENT

One embodiment of this invention will be described with reference to the accompanying drawing in detail.

Figure 1:
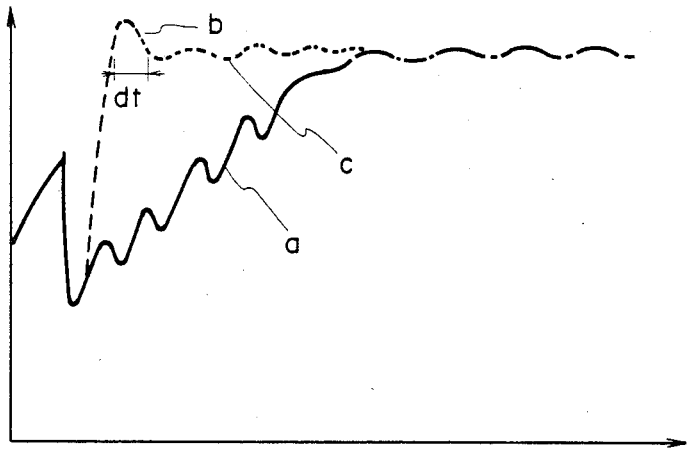
FIG. 1 is a graphical representation indicating the starting conditions of an engine and the variations of the supply voltage.

A power source for a glow plug heating control circuit is, in general, a battery on the vehicle. The supply voltage varies with the starting conditions of the engine. For instance in the case when it takes a relatively long time to start the engine, the supply voltage gradually becomes stable as indicated by the curve a in FIG. 1. When, on the other hand, the engine is started in a relatively short time, the supply voltage becomes stable in a short time as indicated in the curve c in FIG. 1. In this case, the voltage is increased quickly as the speed of the engine increases; i.e., a high voltage as indicated at b in FIG. 1 is produced. This high voltage excessively heats the heat generating coil of an ultra-high-speed heating glow plug, causing the heat generating coil to break or to melt. Thus, in order to overcome such a difficulty, it is necessary to detect the high voltage, so that, during excessively high voltage periods heating current is interrupted in the ultra-high-speed heating circuit. Thus, the ultra-high-speed heating is suspended and instead, an ordinary heating operation or a quick heating operation is carried out. This invention is fundamentally based on the above-described technical concept.

Figure 2:
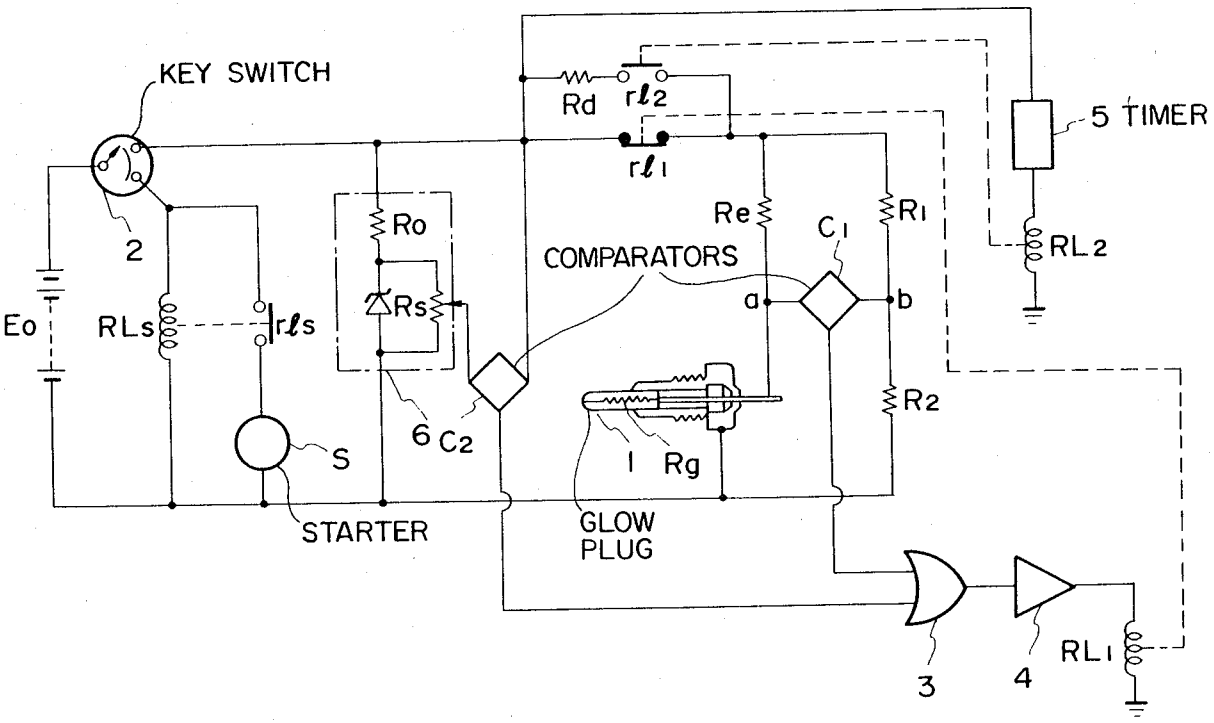
FIG. 2 is a circuit diagram of a glow plug voltage control device according to this invention.

FIG. 2 is a circuit diagram showing a glow plug voltage control circuit according to the invention. In FIG. 2, reference character $E_0$ designates a supply voltage which is in general, provided by a battery on a vehicle; reference numeral 1 designates a glow plug, reference characters Rg designate the resistance of the heat generating coil in the glow plug reference characters Re designate a current detecting resistor having a resistance which is not more than 1/10 of the resistance which the glow plug has at room temperature. Also in FIG. 2, reference characters $r1_1$ designate the normally closed contact means of a first relay, $r1_2$ designate the normally open contact means of a second relay, Rd designate a voltage dropping resistor for controlling current in the glow plug, and reference numeral 2 designate a key switch. The current flows in the glow plug through a circuit consisting of the power source $E_0$, the switch 2, the relay contact means $r1_1$, or the voltage dropping resistor Rd, and the relay contact means $r1_2$, the current detecting resistor Re, and the glow plug 1.

Further in FIG. 2, reference characters RLs designates a starter relay coil, $rl_s$ designates the normally open contact means of a starter relay, S designates a starter, reference numeral 6 designates a voltage setting unit comprising a Zener diode $Z_D$, and resistors $R_0$ and $R_S$. Reference characters $R_1$ and $R_2$ respectively designate resistors which form a bridge circuit with the current detecting resistor Re and the resistance Rg of the heat generating coil in the glow plug. Also in FIG. 2, reference characters $C_1$ designates a comparator which is connected between the terminals a and b of the bridge circuit such that it provides an output signal when a voltage across the terminals a and b reaches a predetermined value, and $C_2$ designates a comparator. The comparator $C_2$ has one terminal connected to the power source and another terminal connected to the set terminal of the voltage setting unit so that the comparator $C_2$ produces an output signal when the supply voltage becomes higher than the steady-state voltage.

Further in FIG. 2, reference numeral 3 designates an OR circuit whose input terminals are connected to the output terminals of the comparators $C_1$ and $C_2$, respectively; reference numeral 4 designates an amplifier connected to the output terminal of the OR circuit 3; reference characters $RL_1$ designates the relay coil of the first relay having one terminal connected to the output terminal of the amplifier 4 and another terminal grounded; reference numeral 5 designates a timer which is connected through the key switch 2 to the power source so that it produces an output to operate the second relay a predetermined time after the key switch 2 is operated; and reference characters $RL_2$ designates a relay coil of the second relay which has one terminal connected to the output terminal of the timer 5 and the other terminal grounded.

The operation of the control circuit thus organized is described below.

When the key switch 2 is operated, the starter relay coil $RL_S$ is energized, so that the starter relay contact means $rl_S$ is closed to start the starter. Thus, the engine is started. On the other hand, the heating current for the glow plug flows in the above-described circuit consisting of the power source $E_0$, the key switch 2, the relay contact means $rl_1$, the current detecting resistor Re and the glow plug 1, thus starting the ultra-high-speed heating operation as indicated by the curve a in FIG. 3. When the temperature of the glow plug reaches a predetermined temperature $T_M$ which is lower than a preset preheating temperature $T_S$ (FIG. 3), the voltage across the terminals a and b of the bridge circuit exceeds the value set in the comparator $C_1$, and therefore the comparator $C_1$ produces the output signal. The output signal thus produced is applied through the OR circuit 3 to the amplifier 4, where it is amplified. The output signal, thus amplified energizes the first relay coil $RL_1$. As a result, the contact means $rl_1$ is opened, so that the heating current is interrupted and the ultra-high-speed heating operation is suspended.

the Timer 5 produces an output at a predetermined time after the operation of the key switch 2, to energize the second relay coil $RL_2$. As a result, the contact means $rl_2$ is closed, so that the voltage across resistor Rd is inserted, in series, into the heating current circuit of the glow plug. Upon insertion of the resistor Rd, the heating speed is decreased and the quick heating operation is effected as indicated by the curve b in FIG. 3. Ordinarily, the control circuit operates as described above.

Figure 3:
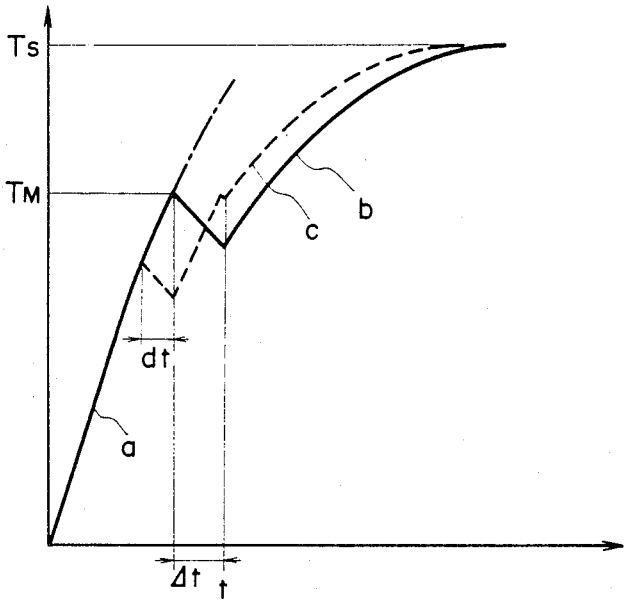
FIG. 3 is a graphical representation indicating glow plug temperature characteristics in the use of the glow plug voltage control device according to the invention.

As shown in FIG. 3, in order to change the ultra-high-speed heating operation as indicated by the curve a into the quick heating operation, the heating operation is suspended for a period of time $\Delta t$ after the temperature of the glow plug reaches the predetermined temperature $T_M$. However, if the period of time $\Delta t$ is made shorter, then the ultra-high-speed heating operation (curve a) is changed smoothly or continuously to the quick heating operation (curve b). In the case where the engine is started in a short time as indicated by the curve c in FIG. 1 and the high voltage is produced as indicated by the curve b in FIG. 1, a large heating current flows in the ultra-high-speed heating circuit of the glow plug; i.e., the heat generating coil of the glow plug is excessively heated. When such a high voltage being higher than the steady-state voltage is produced, the comparator $C_2$ provides a output, so that the first relay is operated to operate its contact means $rl_1$. As a result, the ultra-high-speed heating circuit is opened, so as to interrupt the flow of the heating current in the heat generating coil of the glow plug due to the high voltage. This can prevent the heat generating coil of the glow plug from breaking or melting off due to overheating. The temperature characteristic of the glow plug in this case is such that the heating is suspended for a period of time dt during which the high voltage is produced, as indicated by the curve c in FIG. 3.

Figure 4:
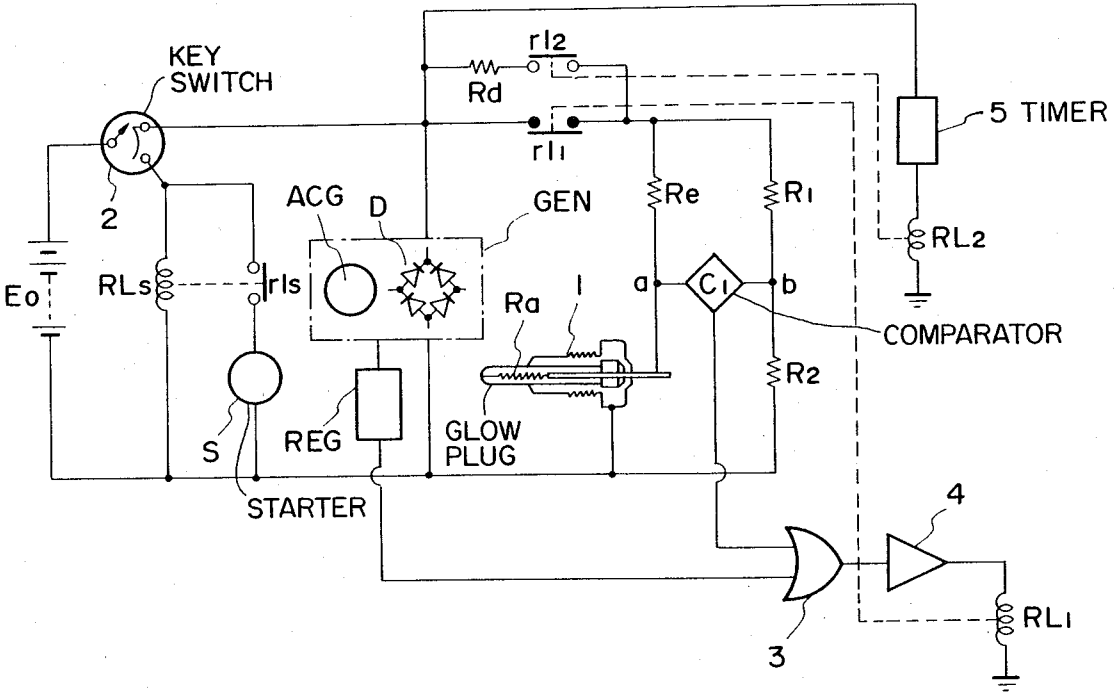
FIG. 4 is a circuit diagram illustrating another embodiment of a glow plug voltage control circuit according to the present invention.

FIG. 4 illustrates another embodiment of the present invention in which the glow plug voltage control circuit is connected to a charging generator. In FIG. 4, reference characters GEN denote a generator which includes an alternating current generator ACG. The output terminals of the generator are connected to a rectifier D which, when the generator ACG is rotated by the engine, rectifies the alternating current output of the generator into direct current. A regulator REG is connected to the generator GEN and is adapted to produce a signal when the output voltage developed by the generator exceeds a steady voltage. The output of the regulator REG is connected to the OR gate 3. The voltage-dropping resistor Rd and the relay contact $Rl_1$ are connected to the output terminal of the generator GEN at a point nearest thereto. Portions identical to those shown in FIG. 2 are designated by like reference characters and need not be described again here.

In operation, when the output voltage produced by the generator GEN does not increase by an abnormal amount, the circuit operates in the same manner as described in connection with the first embodiment, illustrated in FIG. 2. Assume now that the output voltage produced by the generator GEN rises abnormally while the glow plug 1 is being heated rapidly through the closed relay contact $rl_1$. The regulator REG responds to this condition by producing a signal applied to the OR gate 3, whereby the first relay coil $rl_1$ is energized through the amplifier 4 to open the relay contact $rl_1$. This cuts off the flow of current to the glow plug and prevents the glow plug from being burned out.

In an automotive vehicle, a difference develops between the generator terminal voltage and the battery terminal voltage owing to the influence of the resistance offered by the conductors, with the battery voltage being lower than the generator terminal voltage. Accordingly, by adopting the arrangement of the second embodiment wherein an abnormality in the generator output is sensed, the glow plug can be protected against burn-out even if the inventive voltage control circuit therefor is connected to a charging generator.

In accordance with the present invention as described and illustrated hereinabove, a glow plug can be heated rapidly by applying a high voltage thereto under a condition where the power supply voltage is below a certain steady voltage. This enables a diesel engine to be started instantaneously. When, on the other hand, the power supply voltage increases to an abnormal degree during the rapid heating of the glow plug, the circuit arrangement of the invention temporarily cuts off the voltage applied to the glow plug to protect it against burn-out. The invention therefore provides the advantage of a quick start while at the same time assuring that the glow plug will not be damaged by large fluctuations in supply voltage.

What we claim is:

1. A circuit for controlling a voltage applied to a glow plug having a heating element, and for protecting the glow plug from being overheated, said circuit comprising:

sensing means for producing a signal when the power supply voltage exceeds a predetermined value;

a circuit network comprising a normally closed relay contact means, connected in parallel with a serially connected voltage-dropping resistor, for providing electrical contact between the power supply and the glow plug, and a normally open relay contact means for providing electrical contact between said voltage dropping reisitor and the glow plug, said circuit network being serially connected with the heating element of the glow plug and connectable to the power supply; and a timer connectable to the power supply;

said normally closed relay contact means being opened in response to said sensing circuit producing said signal, and said normally closed relay contact means being opened in response to the temperature of the heating element exceeding a preset value which is below a steady-state heating temperature;

said normally open relay contact being closed by said timer a predetermined time after voltage is applied to the glow plug.

2. The circuit according to claim 1, further comprising a first comparator for sensing the state of balance of a bridge circuit one of whose arms is the heating element of the glow plug, said comparator producing an output signal upon sensing that the temperature of the heating element has exceeded said preset value.

3. The circuit according to claim 2, further comprising a second comparator for comparing the power supply voltage with an output produced by a voltage setting unit which stabilizes the power supply voltage by means of a Zener diode, said normally-closed relay contact being opened by an output from said second comparator.

4. The circuit according to claim 2, further comprising an OR gate whose two inputs are the outputs of said first and second comparators, said normally-closed relay contact being opened by an output from said OR gate.

5. A circuit for controlling a voltage applied to a glow plug having a heating element, and for protecting the glow plug from being overheated, said circuit comprising:

receiving means for receiving a power supply voltage;

a bridge circuit comprising two pairs of resistors, one pair including the heating element of the glow plug, the resistors in each pair being serially connected at first and second connection points, and the pairs being connected in parallel at third and fourth connection points;

first comparator means, operatively connected to said first and second connection points, for sensing the voltage balance across said bridge circuit and for providing a first output responsive to the temperature of said heating element exceeding a first preset value;

timer means, operatively connected to said receiving means, for measuring the length of time power has been received by said receiving means, and for providing a second output after power has been received for a predetermined time;

a circuit network including a normally closed relay serially connected between said receiving means and said third connection point, a serially connected normally open relay and voltage drop resistor being connected in parallel with said normally closed relay, and switching means for opening said normally closed relay in response to said first output and for closing said normally open relay in response to said second output;

generator means, connected in parallel with said circuit network and said receiving means, for providing a supply voltage; and regulation means, operatively connected to said generator means, for detecting said supply voltage being greater than a predetermined voltage, for providing a regulator output responsive to said detection and for opening said normally closed relay in response to said regulator output.

6. A circuit according to claim 5, further comprising:

sensing means, operatively connected to said receiving means, for sensing when said received power supply voltages is greater than a predetermined voltage and for providing an output responsive to said received power supply voltage being greater than said predetermined voltage.

7. A circuit according to claim 5, wherein said switching means comprises an OR gate having a first input operatively connected to receive said regulator output and a second input operatively connected to receive said first output of said first comparator, and having an output operatively connected to open and close said normally closed relay.

8. A circuit according to claim 6, wherein said switching means comprises an OR gate having a first input operatively connected to receive said regulator output and a second input operatively connected to receive said first output of said first comparator, and having an output operatively connected to open and close said normally closed relay.

* * * * *

UNITED STATES PATENT AND TRADEMARK OFFICE

CERTIFICATE OF CORRECTION

PATENT NO. : 4,511,792

DATED : April 16, 1985

INVENTOR(S) : Hideo Kawamura

It is certified that error appears in the above-identified patent and that said Letters Patent is hereby corrected as shown below:

Column 2, line 11, "a" should be --a--;
line 14, "c" should be --c--;
line 17, "b" should be --b--;
line 60 "a and b" should be --a and b--;
line 62, "a and b" should be --a and b--.

Column 3, line 27, "a" should be --a--;
line 31, "a and b" should be --a and b--;
line 47, "b" should be --b--;
line 52, "a" should be --a--;
line 56, "a" should be --a--;
line 57, "b" should be --b--;
line 60, "c" should be --c--;
line 61, "b" should be --b--.

Column 4, line 7, "dt" should be --dt--;
line 8, "c" should be --c--.

Signed and Sealed this

*Eighth* Day of *October 1985*

[SEAL]

*Attest:*

*Attesting Officer*

DONALD J. QUIGG

*Commissioner of Patents and Trademarks—Designate*